US006840532B2

(12) United States Patent
Plassiard

(10) Patent No.: US 6,840,532 B2
(45) Date of Patent: Jan. 11, 2005

(54) SNOWBOARD BINDING

(75) Inventor: Alain Plassiard, La Murette (FR)

(73) Assignee: Emery S.A., Saint Egreve (FR)

( * ) Notice: Subject to any disclaimer, the term of this patent is extended or adjusted under 35 U.S.C. 154(b) by 392 days.

(21) Appl. No.: 09/899,664

(22) Filed: Jul. 5, 2001

(65) Prior Publication Data

US 2002/0005627 A1 Jan. 17, 2002

(30) Foreign Application Priority Data

Jul. 17, 2000 (FR) ..... 00 09347

(51) Int. Cl.[7] ..... A63C 9/24
(52) U.S. Cl. ..... 280/623; 280/14.22; 280/618
(58) Field of Search ..... 280/623, 14.21, 280/14.1, 14.22, 14.24, 14.36, 607, 611, 616, 617, 618; 411/338, 389, 180, 383, 427

(56) References Cited

U.S. PATENT DOCUMENTS 2,210,048 A * 8/1940 Swanson ..... 411/338
5,261,689 A * 11/1993 Carpenter et al. ..... 280/14.24
5,294,226 A * 3/1994 Chow ..... 411/338
5,542,777 A * 8/1996 Johnson ..... 411/338
5,727,797 A 3/1998 Bowles
5,820,139 A * 10/1998 Grindl ..... 280/14.24
5,901,971 A * 5/1999 Eaton ..... 280/14.24
5,967,531 A * 10/1999 Saillet ..... 280/11.36
6,061,870 A 5/2000 Dodge et al.
6,155,577 A 12/2000 Okajima
6,283,492 B1 * 9/2001 Hale ..... 280/11.36
6,364,323 B1 * 4/2002 Coulter ..... 280/14.22
6,390,492 B1 * 5/2002 Bumgarner et al. ..... 280/607

FOREIGN PATENT DOCUMENTS

DE 198 36 554 A1 1/2000
EP 0 791 380 A1 8/1997
EP 0 979 620 A1 2/2000
WO Wo 00/24482 * 5/2000 ..... 280/14.24

OTHER PUBLICATIONS

Preliminary Search Report in SN FR 0009347.

* cited by examiner

*Primary Examiner*—Hau Phan
(74) *Attorney, Agent, or Firm*—Bugnion S.A.; John Moetteli

(57) ABSTRACT

Snowboard binding comprising a baseplate (1) on which is mounted a bow (7) that is adjustable in terms of position by means of two pairs of nuts and screws and a highback (8) mounted on the bow so chat it is orientable. Each of the screws (25) used to mount the highback (8) on the bow (7) and one of the screws (22, 24) of the pair of screws used to fix the bow to the baseplate arc coaxial and share a common nut (17, 19). This construction has the effect of simplifying the nut-and-screw fittings and of increasing the range of orientation of the highback.

7 Claims, 2 Drawing Sheets

SNOWBOARD BINDING

BACKGROUND OF THE INVENTION

The subject of the present invention is a snowboard binding comprising a baseplate intended to be fixed to a snowboard and having two parallel side walls, a bow having two parallel arms via which it is mounted adjustably in terms of translation on and between the side walls of the baseplate by means of two pairs of nuts and screws, and a curved highback, mounted on the bow so that it is orientable about an axis approximately perpendicular to the baseplate and so that it can be folded down onto the baseplate by means of nuts and screws.

A binding such as this is marketed by the applicant under its name. It is also commercially available under the trade name ROSSIGNOL Model SIS TOOLFREE FMV2.

PRIOR ART

A binding of the same type is known from U.S. Pat. No. 5,727,797, except that the bow is not continuously adjustable on the baseplate but can occupy discrete positions determined by a series of holes in the side walls of the baseplate. Adjustment entails completely unscrewing the nuts, with the risk of losing these.

Patent EP 0 791 380 also discloses a binding of the same type, in which the bow is formed integrally with the baseplate, so that the bow is not adjustable on the baseplate and the highback is articulated to the baseplate by means of two nuts and screws passing through slots that allow the position of the highback to be adjusted in the fore and aft directions, and allow its position to be modified approximately about its axis of curvature. In this case, the options for adjusting the position of the highback are limited. In particular, it is not possible to move the bow forward or to move the curved highback forward without this highback breaking contact with the bow which is specifically designed for this highback to rest against.

SUMMARY OF THE INVENTION

It is an object of the invention to simplify the nut-and-screw fittings and to increase the range of orientation of the highback about its more or less vertical axis.

The binding according to the invention is one wherein each of the screws used for mounting the highback on the bow, and one of the screws of the pair of screws used for fixing the bow to the baseplate are coaxial and share a common nut.

According to a preferred embodiment of the invention, the common nuts are tubular, of polygonal, particularly rectangular, external cross section, and engaged in the slits of the baseplate in such a way as to be prevented from rotating in these slots.

The tubular nuts are preferably secured to the bow.

According to one embodiment, the fixing screws of the highback pass through the highback via oblong slots running in a direction more or less parallel to a plane perpendicular to the axis of bending of the highback, and the long sides of which are notched externally, and the fixing screws bear on the highback via notched inserts. The width of the slots in the highback is advantageously significantly greater than the width of the slits in the baseplate, and the notched inserts are rectangular and have a screw hole which is offset in a direction transversal to the slots so that each of the sides of the highback can be fixed at two different heights by rotating the notched insert through 180° about its screw hole. This allows the highback to be given a lateral inclination.

According to one embodiment of the invention, the bearing face of the heads of the screws used to mount the highback on the bow is notched so as to prevent untimely unscrewing. The surface against which the screw head bears is preferably also notched.

The exterior surface of the notched inserts, against which surface the notched face of the highback mounting screws bears, is preferably also notched.

BRIEF DESCRIPTION OF THE DRAWINGS

The appended drawing depicts, by way of example, a binding according to the invention.

DESCRIPTION OF THE PREFERRED EMBODIMENT

Figure 1:
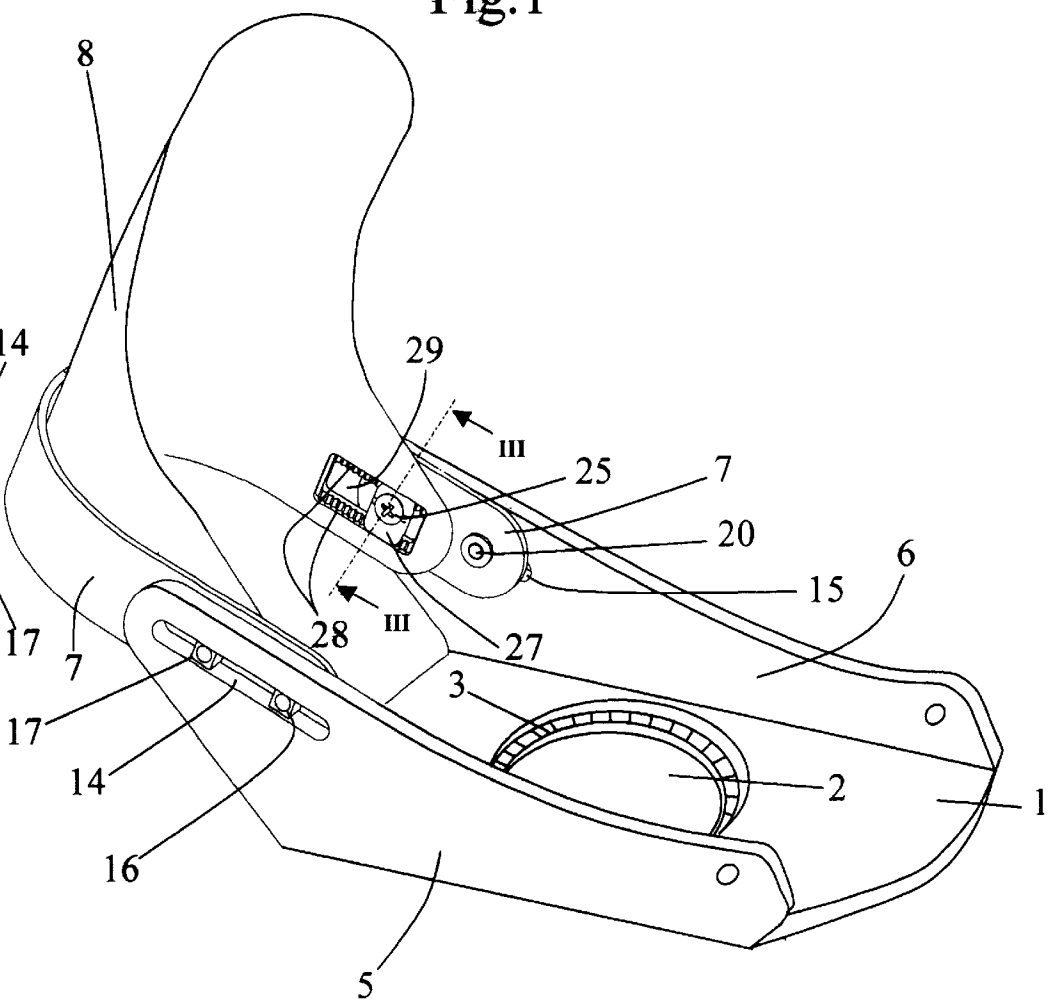
FIG. 1 is a perspective overall view, from the front, of the baseplate, of the bow and of the highback.
Figure 2:
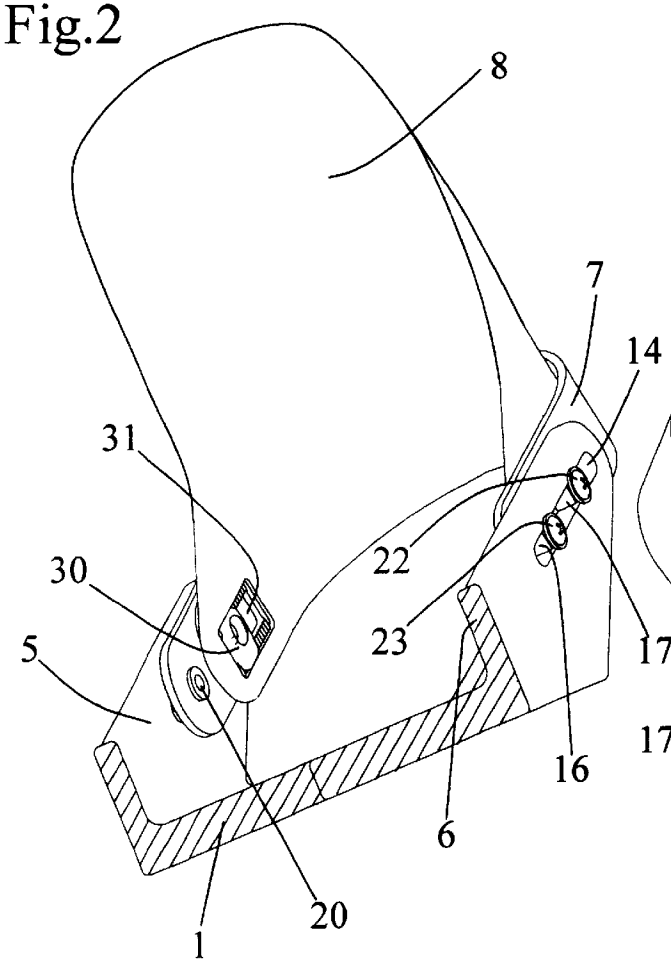
FIG. 2 is a partial perspective view, from the side, of the same elements, viewed from the other side of the binding.

The binding depicted comprises a baseplate 1 having, at its center, a circular cutout 2, via the toothed edge 3 of which the baseplate is fixed orientably to a board by means of a disk (not depicted) itself fixed to the board by means of four screws. The baseplate 1 has two vertical parallel side walls 5 and 6, on and between which is mounted a bow 7 stretching at a slight angle backward and, toward the front, having two parallel arms via which it is fixed to the walls 5 and 6 of the baseplate. Mounted to pivot inside the bow 7 is a highback 8, the shape of which has curvature about an axis approximately perpendicular to the overall plane of the bow 7. The highback 8 forms a kind of gutter section against which the back of the leg can bear. This general design is well known in itself. The highback 8 is mounted to pivot so that it can be folded down forward onto the baseplate. In the known way, the binding is also either equipped with two straps (not depicted) fitted with buckles to fasten them and tighten them onto the boot, or with an automatic binding device.

Figure 3:
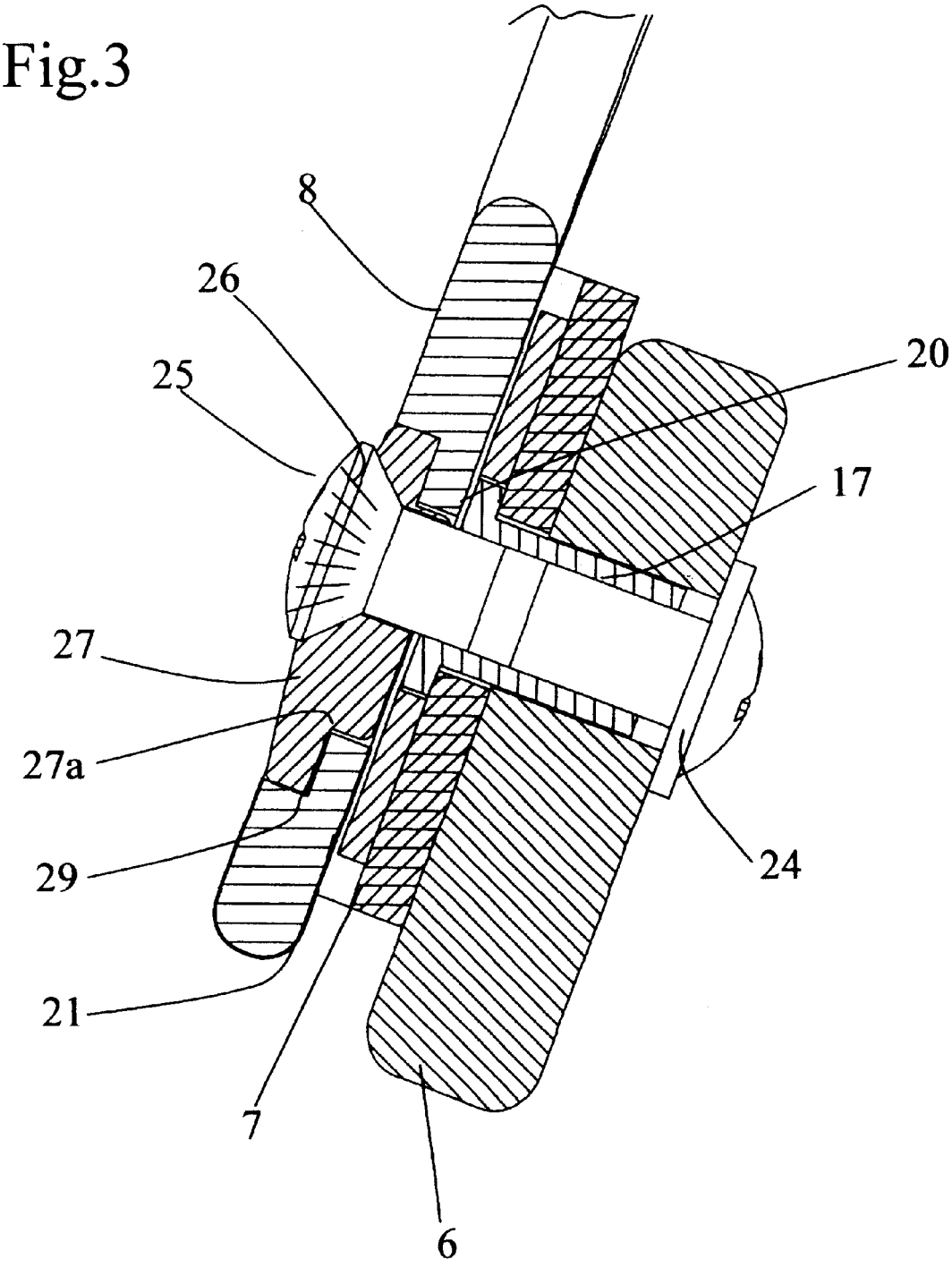
FIG. 3 is an enlarged view in section on III—III of FIG. 1.

The walls 5 and 6 of the baseplate have oblique parallel slits 14 and 15 which determine the direction of the bow 7. Engaged in each of these slits is a pair of tubular nuts of square external cross section 16, 17 and 18, 19. The cross section of these nuts is such that they readily slide in the slits 14 and 15 but that they are prevented from rotating therein. The nuts also pass, without clearance, through the parallel arms of the bow 7 via two holes. As can be seen in FIG. 3 in the case of the nut 17, one of the ends of the nuts has a flange 20 via which it bears on the interior face of the bow 7. The flange 20 is surrounded by a washer 21 of the same thickness as the flange so as to increase the area thereof. The bow is fixed to the baseplate in the desired position using four screws such as the screws 22, 23 and 24, which screw into the corresponding nuts. It should be pointed out that in FIG. 1, these screws have been removed from the side of the wall 5, so as to show the shape of the nuts.

The highback 8 is mounted to pivot on the bow 7, by means of two screws, such as the screw 25, screwed into the nuts 17 and 19. The way in which the highback 8 is mounted using the screw 25 will be described in greater detail in relation to FIG. 3. The mounting on the opposite side is the same.

The screw 25 has a countersunk head with notching 26. This notched head 25 bears in a countersink, also notched, of an insert 27 of rectangular shape pierced with a hole which is offset relative to the center of the insert. The insert 27 is notched on its opposite side to the screw head, in a direction parallel to the plane of section. The notching cooperates with notching 28 formed on the long sides of an oblong slot 29 designed for the screw 25 to pass through. The width of this slot 29 is significantly greater than the diameter of the screw 25, and into this slot there fits a projecting part 27*a* of the insert 27, this part also being rectangular and, like the insert, having the screw 25 pass eccentrically through it. In order to allow the highback 8 to pivot, the screw 25 is not screwed in all the way, but is screwed in far enough for the notches 26 to engage with the corresponding notches of the insert 27, so that the screw 25 is driven by the highback 8 as it pivots, without being able to unscrew itself further from the nut 17 than the angle of pivoting.

It can be seen that by turning the insert 27 round through 180° about the axis of the screw, the highback 8 is raised relative to its position depicted in FIG. 3. The other side of the highback 8 is fixed in the same way by an identical insert 30. By turning just one of the inserts 27 or 30 round, the highback 8 can be given a certain lateral inclination. The orientation of the highback 8 about its axis of curvature is achieved through the choice of position of the inserts 27 and 28 along the slots 29 and 31. The slits 14 and 15 could be replaced by a number of holes. In such a case, the bow 7 would be able to occupy a limited number of positions.

What is claimed:

1. A snowboard binding comprising a baseplate intended to be fixed to a snowboard and having two parallel side walls, a bow having two parallel arms by which the bow is adjustably mounted via two pairs of nuts and screws for translation on and between the walls of the baseplate, and a curved highback, mounted on the bow so that it is orientable about an axis approximately perpendicular to the baseplate and so that it can be pivotably folded down onto the baseplate, wherein the screws of the highback on each side of the sidewall which mount the highback on the bow, share a common nut with a screw that fixes the bow to the baseplate, the bow fixing screw being located on an opposite side of the sidewall and further being coaxial with the corresponding highback mounting screw.

2. The binding as claimed in claim 1, wherein the common nuts are secured to the bow.

3. The binding as claimed in either of claims 1 or 2, wherein the screws of the highback pass through the highback via oblong slots having long sides running in a direction more or less parallel to a plane perpendicular to the axis of orientation of the highback, the long sides of which being notched externally and wherein the screws bear on the highback via notched inserts.

4. The binding as claimed in one of claims 1 to 2, the side walls of which each have an oblique slot, wherein the common nuts are tubular, of polygonal external cross section, and engaged in the slot of the baseplate in such a way as to be prevented from rotating in these slots.

5. The binding as claimed in claim 4, wherein the width of the oblong slots in the highback is significantly greater than the width of the slots in the baseplate, and wherein the notched inserts have a screw hole which is offset in a direction transversal to the slots so that each of the sides of the highback can be fixed at two different heights by repositioning the notched insert in the slot through 180° about the axis of its screw hale.

6. The binding as claimed in claim 4, wherein the bearing face of the heads of the screws for mounting the highback on the bow is notched.

7. The binding as claimed in claim 6, wherein the exterior surface of the notched inserts, on which surface the highback mounting screws bear, is also notched.

* * * * *